US005515882A

United States Patent [19]

Hennis

[11] Patent Number: 5,515,882

[45] Date of Patent: May 14, 1996

[54] APPARATUS FOR INSTALLATION OF A FIXTURE ON A SURFACE

[76] Inventor: Ronald H. Hennis, 4762 S. 162nd St., Omaha, Nebr. 68135

[21] Appl. No.: 493,711

[22] Filed: Jun. 22, 1995

[51] Int. Cl.[6] ..... F16K 43/00; E03C 1/04

[52] U.S. Cl. ..... 137/315; 4/676; 4/678; 4/695; 137/359; 137/801

[58] Field of Search ..... 4/676, 677, 678, 4/695, 696; 137/315, 359, 360, 801

[56] References Cited

U.S. PATENT DOCUMENTS

| | | | |
|---|---|---|---|
| 2,708,449 | 5/1955 | Keighley | 137/359 |
| 2,848,721 | 8/1958 | Frederickson | 4/676 |
| 3,010,474 | 11/1961 | Moen | 137/359 |
| 3,013,727 | 12/1961 | Freer | 137/360 |
| 3,029,831 | 4/1962 | Leete | 137/360 |
| 3,117,588 | 1/1964 | Billeter | 137/359 |
| 3,427,049 | 2/1969 | Politz | 285/46 |
| 3,807,453 | 4/1974 | Dom et al. | 137/359 |
| 4,186,761 | 2/1980 | Guarnieri | 137/315 |
| 4,281,857 | 8/1981 | Randall | 285/34 |
| 4,356,574 | 11/1982 | Johnson | 4/676 |
| 4,516,753 | 5/1985 | Thomsen | 137/315 |
| 4,616,968 | 10/1986 | Giannuzzi | 411/342 |
| 4,620,328 | 11/1986 | Lissau | 4/676 |
| 4,671,316 | 6/1987 | Botnick | 137/315 |
| 4,738,275 | 4/1988 | Buckalew | 137/315 |
| 4,760,861 | 8/1988 | Botnick | 137/359 |
| 4,848,395 | 7/1989 | Krippendorf | 137/359 |
| 5,010,922 | 4/1991 | Agresta | 137/359 |
| 5,050,246 | 9/1991 | Huntoon | 4/192 |

*Primary Examiner*—George L. Walton
*Attorney, Agent, or Firm*—Philip J. Lee

[57] ABSTRACT

A apparatus for installation of a fixture, particularly faucets, through a flat surface, without access to the opposing side of the surface that faces away from the fixture, comprises a "V" shaped spring assembly wherein the apex of the spring is mounted on the threaded tail-piece of the fixture and the spring assembly comprises two wings that extend outward and toward the base of the fixture, which wings can be laterally compressed while being inserted into an installation hole through the flat surface and, after having fully been inserted through the hole, extend outward to engage the opposing side of the flat surface to prevent the extraction of the fixture, and the base of the fixture threadingly receives a collar having an outer diameter in excess of the installation hole and which, when screwed down causes the flat surface to be clamped between the underside of the collar and the top of the wings of the spring assembly, and centrally located flanges extend from the top of the spring assembly as a means for laterally compressing the spring assembly to allow extraction of the fixture, if necessary.

18 Claims, 6 Drawing Sheets

APPARATUS FOR INSTALLATION OF A FIXTURE ON A SURFACE

BACKGROUND OF THE INVENTION

1. Field of invention

The present invention relates generally to apparatus for the installation of a fixture on a surface and more particularly to a new and improved apparatus for quickly installing a fixture in an opening in a flat surface.

2. Description of Related art

The installation of fixtures on a flat surface is frequently hampered by the inaccessibility of the side of the surface away from the installer. A frequent occasion for such difficulty is the installation of a faucet on a countertop adjacent to a sink wherein the plumbing under the sink impedes the access to the underside of the counter, as does the cramped space of the usual cabinetry housing the sink. A variety of methods and devices have been proposed to aid in the installation procedure; however, the proposed solutions commonly require the installer to work under the sink at some point to secure the underside of the faucet beneath the counter to prevent the fixture from upward movement. Examples of such proposed solutions include an elongated nut member as described in U.S. Pat. No. 5,050,246 to Huntoon, a spring biased washer with a means for quickly releasing the spring, as described in U.S. Pat. No. 4,186,761 to Guarnieri, and a cup shaped retaining member described in U.S. Pat. No. 3,117,588 to Billeter. All of the foregoing require the use of a fastening means that must be applied from the underside of the sink or counter. In two instances, U.S. Pat. No. 5,010,922 to Agresta and U.S. Pat. No. 4,848,395 to Krippendorf, a base plate, that is separately affixed to the counter with the faucet being fixed to the base plate at a later time, is used with toggle mechanisms securing the base plate so that the base plate can be secured and removed without working under the counter. The use of separate base plates, however, introduces unwanted complexity into the installation and requires two fastening mechanisms each of which can loosen independently of each other. In addition, the toggle mechanisms for securing the base plates will fail if there is a shift of the position of either the base plate or the toggle.

The use of auxiliary faucets, such as are used with water purifiers, has increased in popularity. Since such faucets are frequently installed by homeowners rather than skilled plumbers, it is desirable to provide a simple apparatus for securely installing and easily removing such fixtures without requiring access to the underside of the installation surface.

SUMMARY OF THE INVENTION

The present invention comprises an improved apparatus for quickly, securely and removably installing a fixture to a surface through an opening in the surface. The apparatus of the present invention is particularly adapted for the installation or removal of an auxiliary or supplemental faucet without the necessity of making fastening connections under the sink or counter. Single line faucets customarily have a generally cylindrical base member from which a tail piece, consisting of the inlet pipe, extends downward. Other fixtures, particularly, electrical fixtures have similar configurations, with the tail piece comprising threaded electrical conduit rather than a fluid conduit. The tail piece and base are generally coaxial, and for the purposes of the description of the present invention, are considered to be coaxial. In the present invention, the tail piece and the base are externally threaded, at least at the lower end of each piece. A generally "V" shaped spring with a central opening sufficient to receive the tail piece is welded or otherwise fastened to a nut at the apex of the "V" shaped spring. The nut is machined with internal screw threads, engageable with external screw threads on the tail piece. In this manner, the spring, when the nut is threaded on the tail piece, is secured in its vertical position and is adjustable in that position by rotation relative to the tail piece. The spring is oriented with its apex pointed away from the fixture to present two outwardly projecting, upwardly angled wings which, when uncompressed, extend outward to a width in excess of the radial dimension of the base member. The upper end of each wing of the spring, in addition, includes a horizontal, inwardly projecting shoulder normal to the axis of the tail piece. At the innermost end of each spring shoulder, a flange extends upward from the spring shoulder to a height approximately equal to or less than the usually expected depth of the installation surface. The apparatus, in addition, comprises an internally threaded collar received on the threaded outer surface of the base member and projecting outward with a flat bottom surface that provides a flange of greater diameter than the base member. The upward extending spring flanges are of approximately the same radial dimension as the base member to avoid restriction or limitation of the downward movement of the collar.

In preparation for installation of the faucet, a hole is made through the sink, counter or other surface at which the faucet is to be installed. The installation hole is formed slightly larger in diameter than the diameter of the base member and smaller than the both the outer diameter of the collar and the outward extension of the widest projection of the spring wings when relaxed. In preparation of the apparatus for installation, the location of the spring member relative to the base member may be adjusted according to the thickness of the installation surface, if desired to avoid the exposure of excess screw threads above the collar upon completion of installation. The location of the spring is adjusted by rotating the spring and attached nut relative to the tail piece. The faucet is inserted, tail piece first, through the surface opening. As the faucet is lowered through the counter, the spring wings are inwardly compressed by the sliding action of the inner surface of the installation hole on the angled outer surface of the spring wings. When the fixture has been sufficiently inserted, the underside of the installation surface will pass the spring shoulders at which point, the spring wings will be free to expand outwardly and will no longer be inwardly compressed. The shoulders of the extended spring wings will then engage the underside of the installation surface to prevent the faucet from being retracted upward through the surface opening. By rotation of the collar relative to the base member, the collar is then advanced downward until the installation surface is firmly and securely clamped between the underside of the collar and the top surface of the spring wing shoulders. As the spring assembly becomes subject to vertical compression, the spring wings may move outward until the spring flanges engage the inner sides of the installation hole and then the spring flanges serve to prevent the further outward movement of the spring wings, which if unstopped could lead to a collapse of the spring assembly. In this manner, the faucet or other fixture is securely clamped on the surface without the necessity of the installer being required to or attempting to fasten or adjust the fixture from the under side of the surface by wrench or by hand.

The removal of the fixture is achieved by the unscrewing and upward movement of the collar exposing the upper end of the flanges which are then pressed inward using a screwdriver or other tool until the spring wings have been sufficiently compressed to allow the upward removal of the faucet through the opening. The length of the inward projection of the spring shoulders is limited to approximately slightly less than the difference in the radius between the tail piece and the inside dimension of the base member so that the spring member can be compressed to a point smaller than the opening, i.e. smaller than the outside surface of the base member.

A second embodiment of the apparatus of the present invention differs in the length of the upward extending spring flanges, which, in the second embodiment, extend upward from the spring shoulder past the bottom edge of the base member to a height approximately equal to than the usually expected depth of the installation surface. The upward extending spring flanges are received within diametrically opposed slots formed in the base member with openings at the bottom edge of the base member and extending upward at least the length of the spring flanges. The fit of the flanges within the base member slots prevents rotation of the spring member relative to the base member unless the spring wings are inwardly compressed to release the spring flanges from the base member slots. Therefore, the spring must be inwardly compressed to adjust location of the spring assembly relative to the base member. When the adjustment is complete and the appropriate position of the spring assembly is achieved, the spring wings are released and the spring flanges are again secured within the base member slots. The greater length and the upward extension of the spring flanges provide convenient access to the flanges even when the apparatus has been installed in a thicker countertop to enhance the removal of the fixture, if necessary.

The principal aim of the present invention is to provide a new and improved fixture installation apparatus which meets the foregoing requirements and which is capable of being installed without access to the underside of the installation surface.

Another and further object and aim of the present invention is to provide a new and improved fixture installation apparatus which meets the foregoing requirements and which will be economical to manufacture.

Yet another and further object and aim of the present invention is to provide a new and improved fixture installation apparatus which meets the foregoing requirements and which will be easily removable without access to the underside of the installation surface.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT

Figure 1:
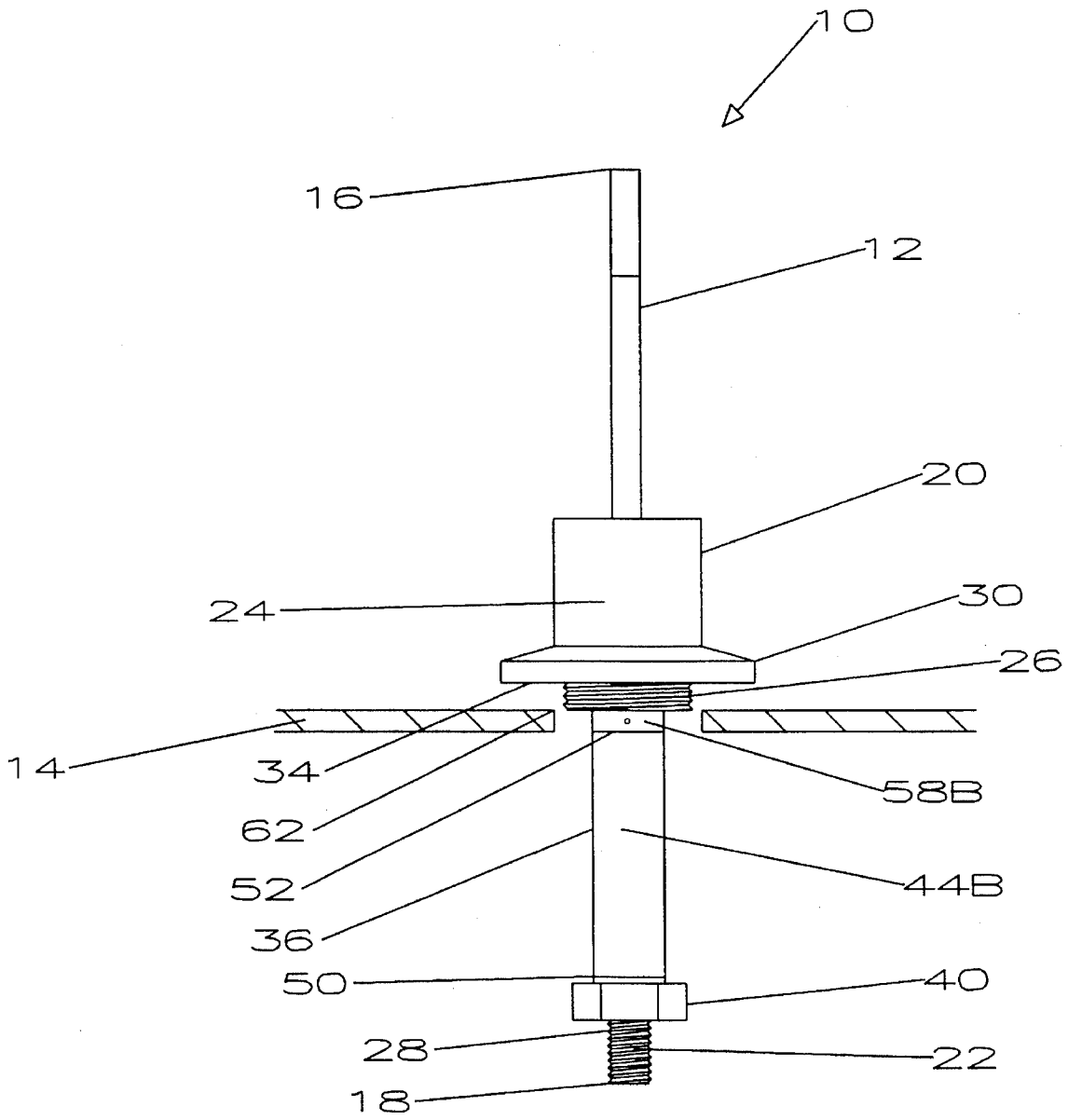
FIG. 1 is a front view of a first preferred embodiment of the invention showing the apparatus of the present invention used to install a faucet through a counter, the counter being shown in sectional view.
Figure 2:
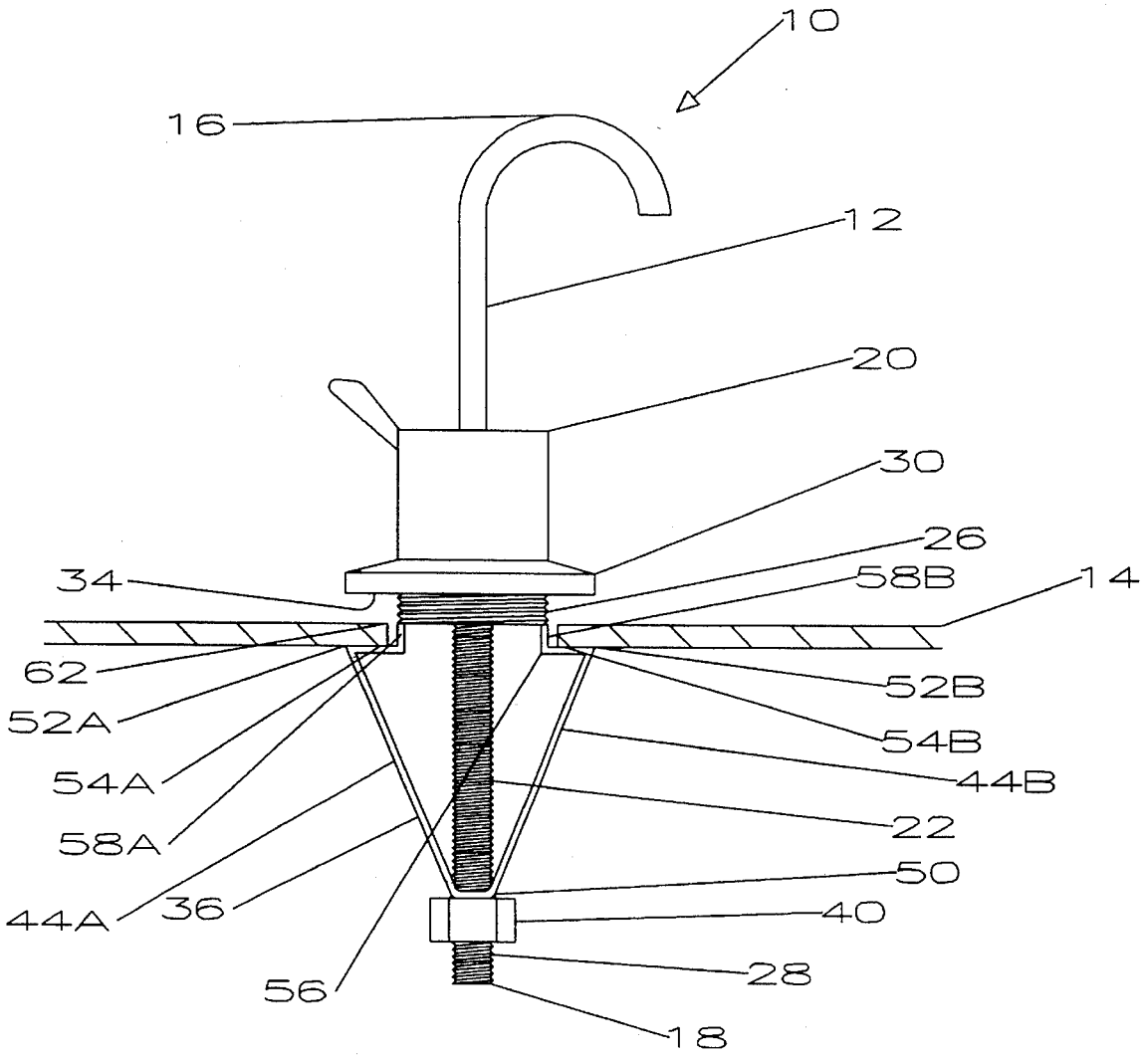
FIG. 2 is a side view of a first preferred embodiment of the invention showing the apparatus of the present invention used to install a faucet through a counter.
Figure 3:
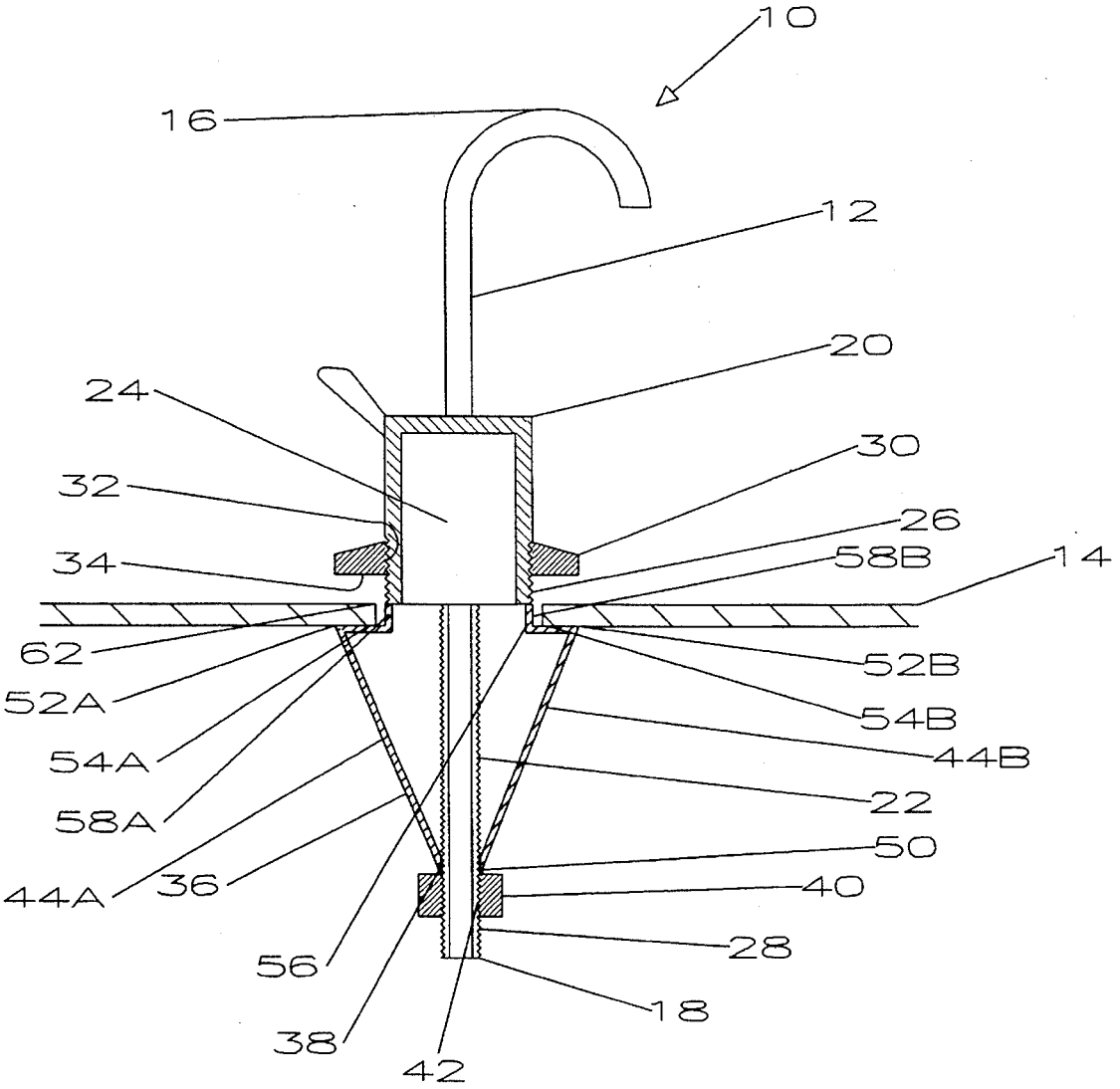
FIG. 3 is a cross sectional side view of a first preferred embodiment of the invention showing the apparatus of the present invention used to install a faucet through a counter.

With reference to the Drawings wherein like numerals represent like parts throughout the Figures, a first preferred embodiment of the fixture installation apparatus of the present invention is generally designated by numeral 10 in FIGS. 1, 2 and 3. For the sake of clarity and ease of reference herein, the fixture to be installed by means of apparatus 10 is referred to as a faucet 12 to be installed vertically through a horizontal counter 14. Accordingly, faucet 12 is referred to as having a top end 16 and a bottom end 18 and the terms "up", "upper", "upward" or "top" mean toward the top end 16 and the terms "down", "lower", "downward" or "bottom" mean toward the bottom end 18. The use of faucet 12 and the directional conventions are intended merely as exemplars and not as a limitation of the use of the apparatus 10 which can be used with other fixtures and in other directional orientations.

Faucet 12 has a generally cylindrical base member 20 from the bottom of which a tail piece 22 extends downward, coaxially with base member 20. Tail piece 22 serves as the inlet pipe of faucet 12 and communicates with valve chamber 24, which contains the valving mechanisms that operate the control of water through the faucet 12. Since apparatus 10 functions independently of the faucet valving mechanisms, no detail thereof is illustrated in the Drawings, nor described herein. Both the base member 20 and the tail piece 22 comprise externally threaded surfaces, reference numbered 26 and 28, respectively. The threaded outer surface 26 of base member 20 extends over at least a portion of the lower end of base member 20. The threaded surface 28 of tail piece 22 is shown in the Drawings as extending the entire length of tail piece 22, as that is a frequently encountered configuration; however, the vertical dimension of threaded surface 28 is normally only partially functional as will be described in further detail below. An annular collar 30 comprises an internally threaded surface 32 formed to be received on the threaded surface 26 of the base member 20. Collar 30 can be vertically positioned relative to base member 20 by rotation relative to base member 20. Collar 30 extends radially outward to provide a flat, annular bottom surface 34 of greater diameter than the base member 20.

Apparatus 10 further comprises a generally "V" shaped spring assembly 36. Spring assembly 36 may be made from a single piece of metal or other material molded or shaped to provide a central opening 38 sufficient to receive the tail piece 22. The bottom 50 of spring assembly 36, at the apex of spring assembly 36, is welded or otherwise fastened to a nut 40 machined with internal screw threads 42, engageable with external screw threads 28 on the tail piece 22. The nut 40 is threaded on the tail piece 22 to adjustably secure the vertical position of spring assembly 36 relative to the tail piece 22 and the base member 20 by rotation of nut 40 relative to the tail piece 22. The spring assembly 36 consists of two wing members 44A and 44B that project at an angle upward, toward base member 20, and outward from spring assembly bottom 50. The upper ends 52A and 52B of wings 44A and 44B of the spring assembly 36, when uncompressed, extend outward to a width in excess of the horizontal radius of the base member 20 to approximately the same outer dimension as collar 30. Both upper ends 52A and 52B of wings 44A and 44B include a horizontal, inwardly projecting shoulder, reference numbered 54A and 54B, in the plane generally normal to the axis of the tail piece 22 and parallel to the installation surface. The length of each of the spring shoulders 54A and 54B is limited to approximately slightly less than the difference in the radius between the tail piece 22 and the diameter of the base member 20 to allow the spring assembly 36 to be inwardly compressible to a width approximately equal the diameter of the base member 20. At the innermost end 56 of each spring shoulder 54A and 54B, a flange 58, individually numbered 58A and 58B, extends upward from the spring shoulders 54A and 54B to a height approximately equal to the usually expected depth of the installation surface 14. The distance between the radially outer surfaces of upward extending spring flanges 58A and 58B is approximately the same as the diameter of the base member 20.

In preparation for installation of the faucet in a surface 14, a hole 62 is made through which the faucet is to be installed. The installation hole 62 is slightly larger in diameter than the diameter of the base member 20 and smaller than the both the outer diameter of the collar 30 and the outward extension of the upper ends 52A and 52B of spring wings 44A and 44B, when not compressed. The axial placement of the shoulders 54A and 54B on the spring assembly 36 relative to the base member 20 may be adjusted by rotating the spring assembly 36 relative to tail piece 22. Adjustment of the location of spring assembly 36 may be desired to avoid the exposure of excess screw threads above the collar 30 upon completion of installation or to ensure adequate engagement of collar 30. Tail piece 22 is inserted first, through the hole 62 and the spring wings 44A and 44B are inwardly compressed by the inner surfaces of the installation hole 62 on as outer surface of the spring wings 44A and 44B engage and slide past hole 62. When the upper ends 52A and 52B of the spring wings 44A and 44B clear the underside of the installation surface 14, the spring wings 44A and 44B will be free to expand outwardly and will no longer be inwardly compressed. Upon the outward expansion of spring wings 44A and 44B, the spring shoulders 54A and 54B are parallel to and engage the underside of counter 14. Collar 30 is then rotated to reduce the separation between collar bottom surface 34 and the shoulders 54A and 54B of the extended spring wings 44A and 44B which then engage the underside of the installation surface 14 while the bottom surface 34 of collar 30 engages the top of the installation counter 14. In this way, the counter 14 is firmly and securely clamped between the underside 34 of the collar 30 and the top surface of the spring wing shoulders 54A and 54B.

The removal of the faucet is achieved by the unscrewing and upward movement of the collar 30 until the spring flanges 58A and 58B are sufficiently exposed to allow flanges 58A and 58B to be pressed inward using a screwdriver or other tool until the width between upper end 52A and upper end 52B of spring wings 44A and 44B has been sufficiently reduced to less than the inner diameter of hole 62. If the apparatus 10 is adjusted prior to installation so that the bottom edge of base member 20 is not inserted into hole 62, the fixture 12 may be removed by loosening collar 30 and sliding the base member 20 toward one spring wing 44 to compress the wing 44. The base member 20 may then be tilted to allow the second wing 44 to clear the hole, after which the base member 20 can be straightened and moved in the opposite direction to compress the second wing 44 and allow the first wing 44 to clear the hole 62 as well.

Figure 4:
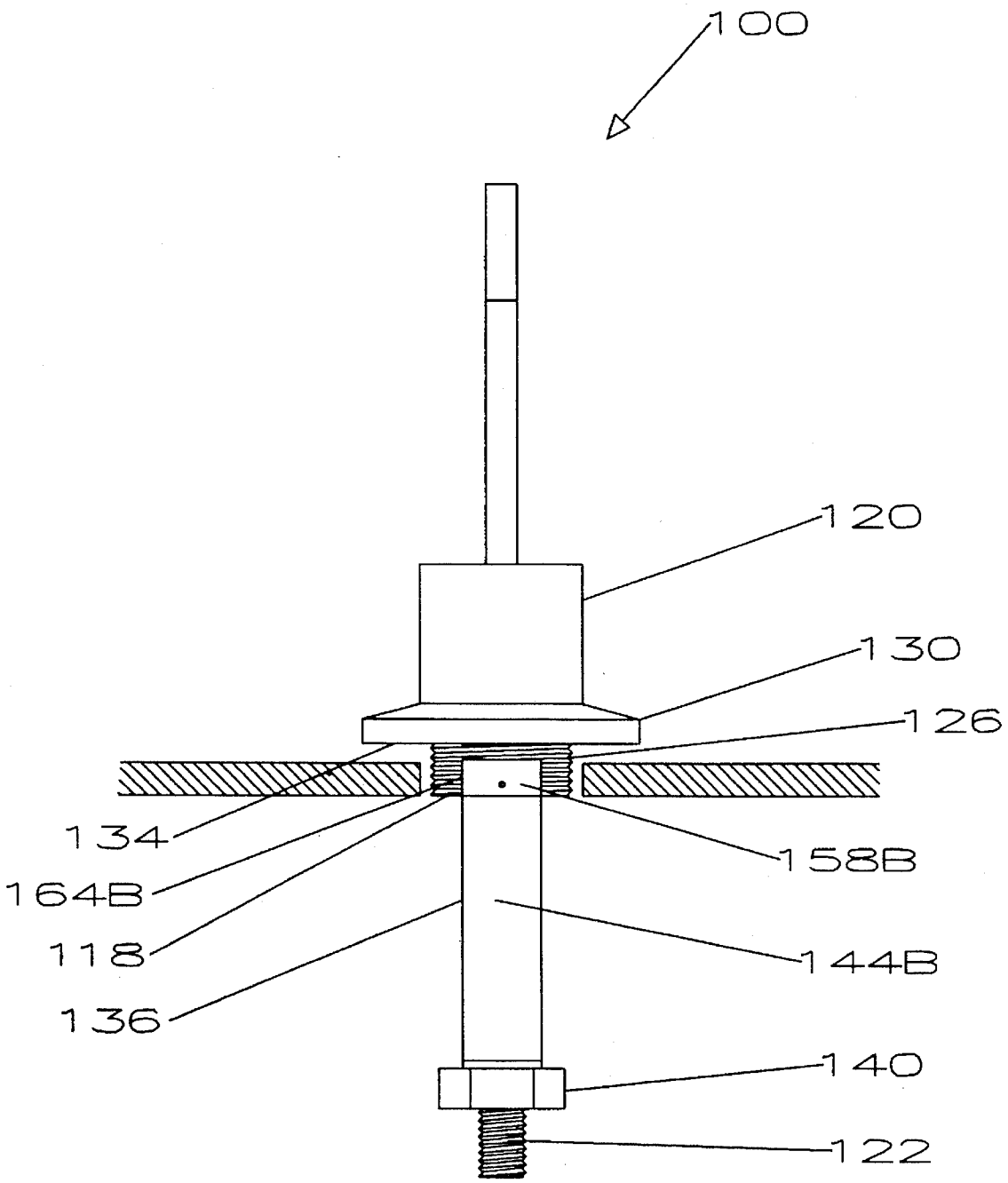
FIG. 4 is a front view of a second preferred embodiment of the invention showing the apparatus of the present invention used to install a faucet through a counter, the counter being shown in sectional view.
Figure 5:
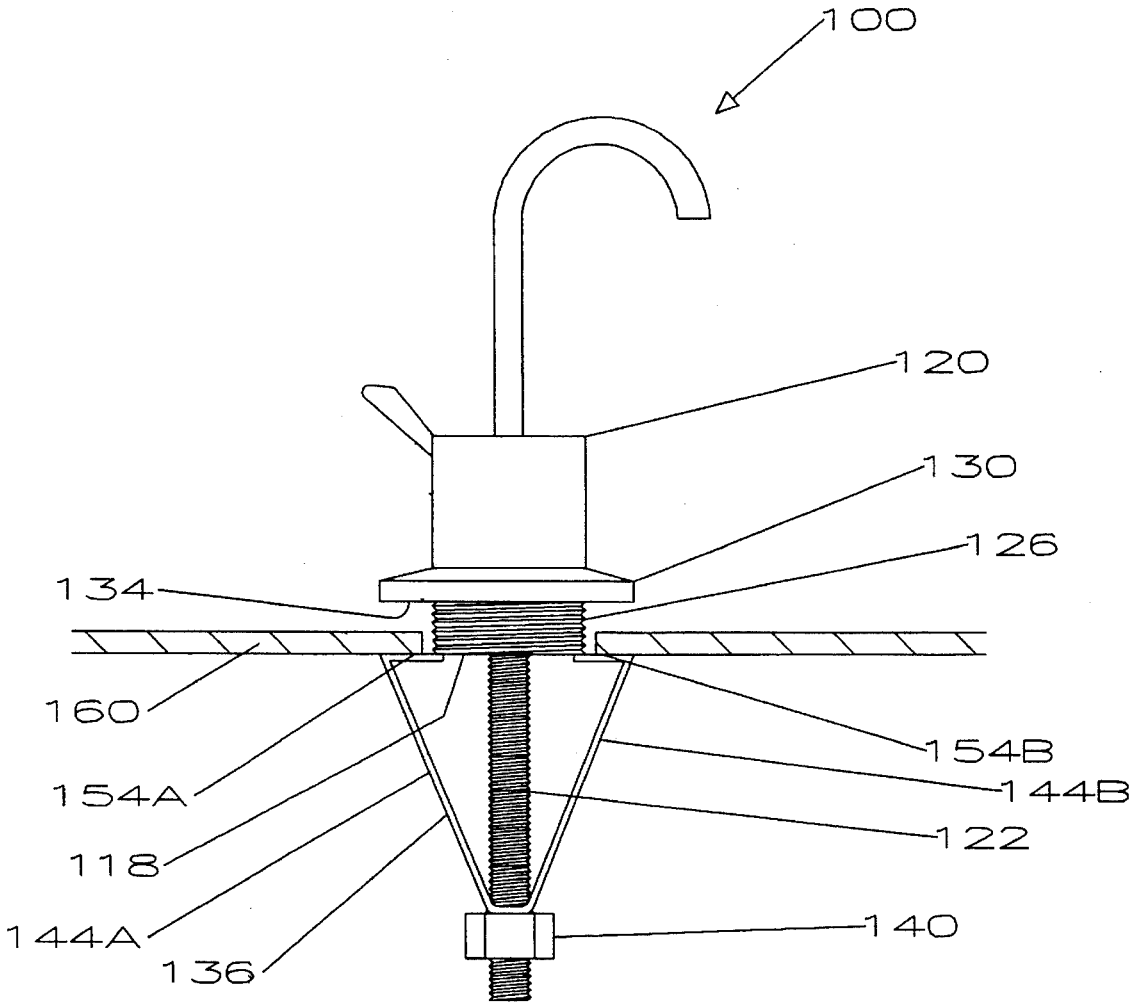
FIG. 5 is a side view of a second preferred embodiment of the invention showing the apparatus of the present invention used to install a faucet through a counter.
Figure 6:
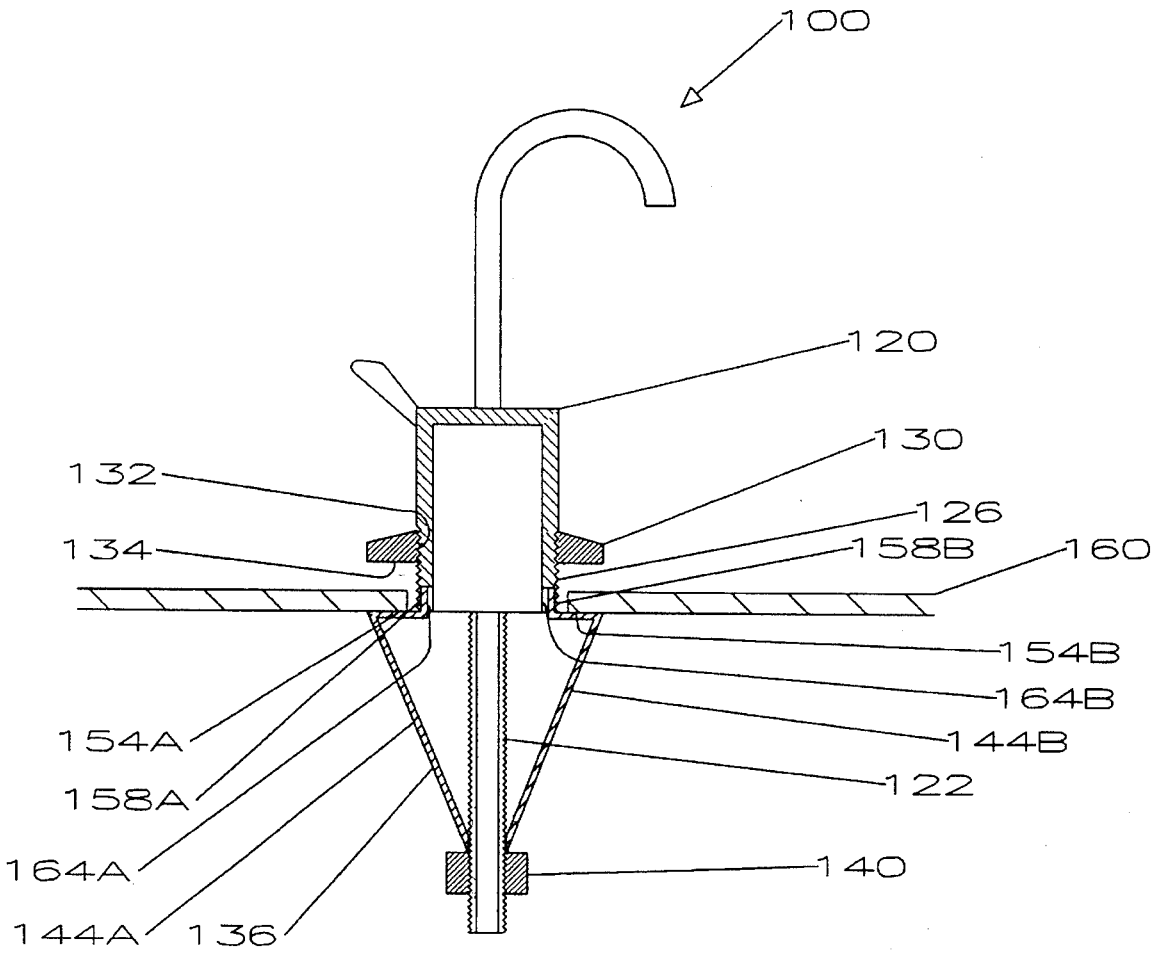
FIG. 6 is a cross sectional side view of a second preferred embodiment of the invention showing the apparatus of the present invention used to install a faucet through a counter.

A second embodiment 100 of the apparatus of the present invention is illustrated in FIGS. 4, 5 and 6, and differs only in the length of the upward extending spring flanges. Accordingly, apparatus 100 has a generally cylindrical base member 120 with a bottom 118 from which a tail piece 122, extends downward coaxially with base member 120. Tail piece 122 is the same function and shape as tail piece 22 of apparatus 10. Base member 120 has an externally threaded surface 126 similar to surface 26 of base member 20 and a collar 130 has an internally threaded surface 132 that is engageable with the threaded exterior surface 126 of base member 120. Collar 130 extends radially outward providing a flat annular bottom surface 134. Apparatus 100 further comprises a spring assembly 136 secured to a nut 140 that is threadingly received on the tailpiece 122. In a manner similar to spring assembly 36, spring assembly 136 comprises two diametrically opposed wings 144A and 144B extending outward and upward at an angle from nut 140. Each spring wing 144A and 144B has a horizontal, inwardly projecting shoulder 154, referenced as 154A and 154B in the Drawings, and an upwardly extending flange 158, referenced as 158A and 158B in the Drawings. Spring flanges 158A and 158B differ from flanges 58A and 58B in the height of the spring flanges. Spring flanges 158A and 158B, in the second embodiment 100, extend upward from the spring shoulders 154A and **154*b*, respectively, past the bottom edge 118 of the base member 120 to a height corresponding to the usually expected thickness of the installation surface 160. The upward extending spring flanges 158A and 158B are received within diametrically opposed slots 164A and 164B formed in the base member 120 with openings at the bottom edge 118 of the base member 120 and extending upward at least the length of the spring flanges 158A and 158B. The retention of the flanges 158A and 158B within the base member slots 164A and 164B prevents rotation of the spring assembly 136 relative to the base member 120 unless both of the spring wings 144A and 144B are inwardly compressed at the same time to release the spring flanges 158A and 158B from the base member slots 164A and 164B. The spring flanges 158A and 158B are recessed radially inward to avoid interference with the screw threads 132 of collar 130 when collar 130 is screwed downward. The height of the externally threaded surface of base member 120 may be greater than that of base member 20 in apparatus 10**.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. In particular, it will be anticipated that a variety of configurations can serve the function of the spring assemblies 36 and 136, including the use of one spring wing rather than two as described herein. It will be further anticipated that base members 20 and 120 as well as collars 30 and 130 may not necessarily be cylindrical, in which event alternative means for adjustably securing the vertical position of the collars 30 or 130 relative to base members 20 or 120 would be required to replace the function of the screw threads 32 and 26 or 132 and 126.

What is claimed is:

1. An apparatus for installing a fixture on an installation surface, the surface having a top side, an underside and an opening therethrough, the apparatus comprising:

A. A fixture base member, and

B. A collar of greater outside dimension than the base member, received around the base member, and having means for being adjustably positionable with respect to the base member, and C. A fixture tail piece extending from the base member, and D. a fixture securing element mounted on, and surrounding a portion of, the tail piece and securely positionable with respect to the base member and collar, the fixture securing element comprising a spring member which is compressible to allow the fixture securing element to pass through the surface opening and which comprises an upper portion which radially expands after the fixture securing element and a portion of the tailpiece pass through the opening to a position below the underside of the installation surface, to engage the underside of the installation surface, preventing the fixture securing element from passing back through the surface opening, whereby the tailpiece and base member are securely fixed relative to the installation surface when the collar is adjusted to tightly engage the topside of the installation surface.

2. The apparatus of claim 1, wherein the spring member further comprises a first end and a second end, and the first spring end is positionably affixed to the tail piece farther from the base member than the second end, and further comprises at least one wing that extends from the first spring end to the second spring end at an angle to the tail piece.

3. The apparatus of claim 2, wherein the outside dimension of the first spring end, in the plane of the installation surface is less than the inside dimension of the opening in the surface and the second spring end, in the relaxed state, spans an outside dimension in the plane of the installation surface that is greater than the inside dimension of the opening in the surface.

4. The apparatus of claim 3, wherein the spring wing is compressible to a dimension sufficiently small to allow passage of the spring wing through the opening in the installation surface.

5. The apparatus of claim 4, wherein the second end of each spring wing comprises a shoulder in the plane of the installation surface.

6. The apparatus of claim 5, wherein each spring wing shoulder extends inward toward the tail piece.

7. The apparatus of claim 6, further comprising flanges extending toward the base member from the inner end of each spring wing shoulder.

8. The apparatus of claim 7, wherein the base member is generally cylindrical with an externally threaded outer surface and the collar comprises an internally threaded inner surface that corresponds to and is engageable with the base member threaded surface.

9. The apparatus of claim 8, wherein the tail piece is generally tubular with an externally threaded outer surface and the fixture securing element further comprises a nut having an internally threaded inner surface that corresponds to and is engageable with the threaded surface of the tail piece.

10. The apparatus of claim 7, wherein the base member further comprises slots sized to receive the spring wing flanges.

11. The apparatus of claim 10, wherein the base member is generally cylindrical with an externally threaded outer surface and the collar comprises an internally threaded inner surface that corresponds to and is engageable with the base member threaded surface.

12. The apparatus of claim 11, wherein the tail piece is generally tubular with an externally threaded outer surface and the fixture securing element further comprises a nut having an internally threaded inner surface that corresponds to and is engageable with the threaded surface of the tail piece.

13. The apparatus of claim 3, further comprising a plurality of spring wings and wherein the spring wings are compressible to a dimension sufficiently small to allow passage of the spring wings through the opening in the installation surface.

14. The apparatus of claim 3, wherein the second end of each spring wing comprises a shoulder in the plane of the installation surface and extending inward toward the tail piece.

15. The apparatus of claim 14, further comprising flanges extending toward the base member from the inner end of each spring wing shoulder.

16. The apparatus of claim 15, wherein the base member is generally cylindrical with an externally threaded outer surface and the collar comprises an internally threaded inner surface that corresponds to and is engageable with the base member threaded surface.

17. The apparatus of claim 8, wherein the tail piece is generally tubular with an externally threaded outer surface and the mixture securing element further comprises a nut having an internally threaded inner surface that corresponds to and is engageable with the threaded surface of the tail piece.

18. The apparatus of claim 17, wherein the base member further comprises slots sized to receive the spring wing flanges.

* * * * *